US007314120B2

(12) United States Patent
Jahkonen

(10) Patent No.: US 7,314,120 B2
(45) Date of Patent: Jan. 1, 2008

(54) MOTOR CONTROL FOR ELEVATOR USING TWO CONTROL SIGNALS

(75) Inventor: Pekka Jahkonen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/355,099

(22) Filed: Feb. 16, 2006

(65) Prior Publication Data

US 2006/0243533 A1 Nov. 2, 2006

Related U.S. Application Data

(63) Continuation of application No. PCT/FI2004/000279, filed on May 11, 2004.

(51) Int. Cl.
*B66B 1/28* (2006.01)

(52) U.S. Cl. ..... 187/293

(58) Field of Classification Search ..... 187/290, 187/293, 296, 297; 318/799, 801, 802, 807
See application file for complete search history.

(56) References Cited

U.S. PATENT DOCUMENTS 4,773,508 A * 9/1988 Mine et al. ..... 187/296
4,982,816 A * 1/1991 Doi et al. ..... 187/296
5,025,896 A * 6/1991 Arabori et al. ..... 187/292
5,788,018 A 8/1998 Mendelsohn et al.
5,828,014 A * 10/1998 Goto et al. ..... 187/292
6,050,368 A * 4/2000 Pakarinen et al. ..... 187/293
6,202,796 B1 * 3/2001 Lee ..... 187/293
7,121,385 B2 * 10/2006 Jahkonen et al. ..... 187/293
2005/0217945 A1 * 10/2005 Kimura et al. ..... 187/277

FOREIGN PATENT DOCUMENTS

WO WO-96/23722 A1 8/1996

* cited by examiner

*Primary Examiner*—Jonathan Salata
(74) *Attorney, Agent, or Firm*—Birch, Stewart, Kolasch & Birch, LLP

(57) ABSTRACT

A method and a system for controlling an elevator that does not change the torque direction, such as an elevator without counterweight. The elevator has an alternating-current electric motor (M1), such as a permanent magnet motor or an asynchronous motor, and a motor drive section (DRIVE1) for controlling the motor and an elevator control section (ECO1) used to control the operation of the elevator. Control channels are provided between the elevator control section and the motor drive section for the transmission of control signals. To control the motor, only position and torque control signals are passed between the elevator control section and the motor drive.

7 Claims, 1 Drawing Sheet

MOTOR CONTROL FOR ELEVATOR USING TWO CONTROL SIGNALS

This application is a Continuation of PCT International Application No. PCT/FI2004/000279 filed on May 11, 2004, which designated the United States, and on which priority is claimed under 35 U.S.C. § 120. This application also claims priority under 35 U.S.C. § 119(*a*) on patent application No(s). 20031295 filed in Finland on Sep. 10, 2003. The entire contents of each of the above documents is hereby incorporated by reference.

BACKGROUND OF THE INVENTION

1. Field of the Invention

The present invention relates to the control of an elevator. In particular, the invention concerns a method for controlling an elevator that works without changing the torque direction, such as an elevator without counterweight, and a control system designed for applying said method. The control method of the invention is applicable for use e.g. in an elevator without counterweight having an alternating-current electric motor rotating at a relatively high speed and a gear system for adapting the speed for elevator operation.

2. Brief Description of the Prior Art

Elevator control systems nowadays typically comprise an elevator control section and a drive section controlling the electric motor (FIG. 1). The elevator control section comprises traffic control TRC, to which the calls issued from different floors are directed. The drive section again typically comprises motion control MOC, speed control SPC, torque control TOC and a safety circuit SAC. The drive control section receives feedback data giving the position of the elevator car for motion control, the speed for speed control, the motor current for torque control, and safety-related control data from safety contactors, by means of which the supply of current to the motor drive can be switched off to stop at a landing.

In present control systems, between the control blocks a relatively large amount of data traffic, generally serial data traffic is needed for the transmission of signals (generally in serial form). Due to this, present control systems are relatively complex. Moreover, speed control is relatively important especially in the case of elevators having a high capacity (high speed, height). By contrast, in slower elevators having a gear system with a large transmission ratio, speed control is not such a critical factor.

SUMMARY OF THE INVENTION

The object of the present invention is to overcome the drawbacks of prior art and to achieve a new and very simple elevator control method and system especially for elevators without counterweight or corresponding elevators in which the torque direction does not change.

In the control method of the invention, a speed reference is computed in the elevator control section instead of in the motor drive section, and it is converted at an early stage into a position reference (position profile), which is thus a signal controlling the motor. In this case, the motor control signal need not be in serial form, which would require e.g. two microcontrollers transmitting and receiving complicated messages, but the motor control signal may be a pulse diagram wherein it is coded e.g. by PWM or frequency modulation, which is used to control the current or voltage signal to be fed into the motor. The motor is typically a synchronous or asynchronous motor provided with permanent magnets.

In the control according to the invention for controlling the motor, only position and torque control signals are transmitted between the elevator control section and the motor drive.

The features of the control method and system of the invention are presented in the claims below.

By applying the invention, the speed control in the motor drive section can be eliminated completely and the motion control partially. In addition, the following advantages are achieved:

- the interface between motor drive and elevator control is very simple,
- due to a smaller number of components, reliability is improved,
- due to the use of basic components, a long product life span,
- no microcontrollers needed,
- elevator safety functions can be implemented in the elevator control section,
- parameters are handled in only one control section, so they need not be transmitted from one control section to another.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE PREFERRED EMBODIMENTS

Figure 1:
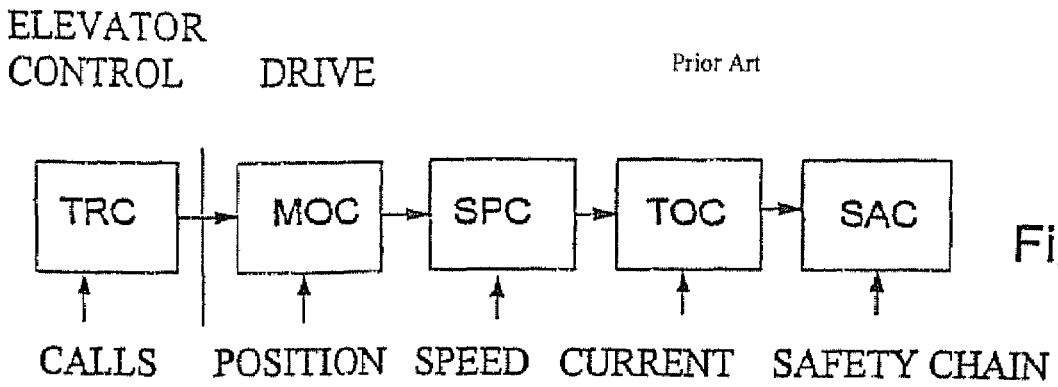
FIG. 1 presents a block diagram of a prior-art elevator control system.
Figure 2:
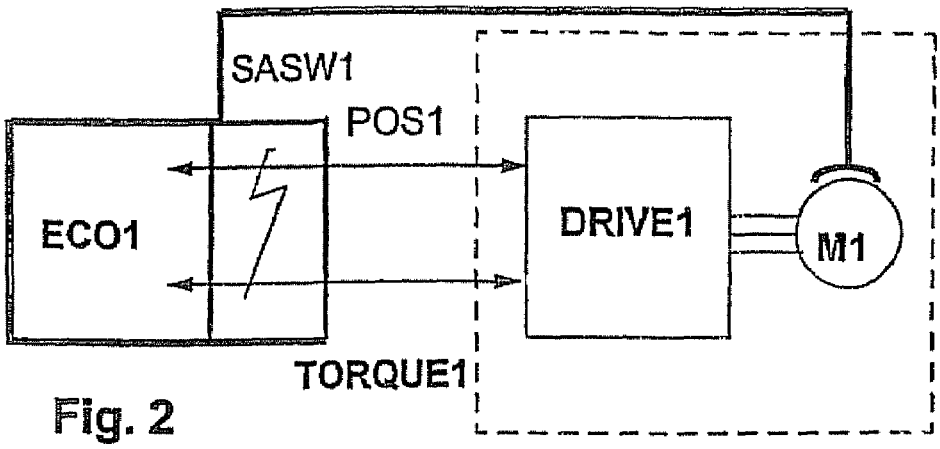
FIG. 2 presents a block diagram of the elevator control system of the invention.

FIG. 2 represents a control system according to the invention for the control of a relatively slow elevator without counterweight. The elevator has an elevator motor M1, e.g. a discoid permanent-magnet alternating-current electric motor mounted in the elevator shaft, and its control system, which is also disposed in the elevator shaft. The control system comprises a drive section DRIVE 1 integrated in conjunction with the elevator motor M1 and, disposed separately from the control section, an elevator control section ECO1, including the control of safety switches SASW1. Between the drive section and the control section, only two signals are transmitted in two channels: position POS1 and torque TORQUE1, as will be described later on.

Figure 3A:
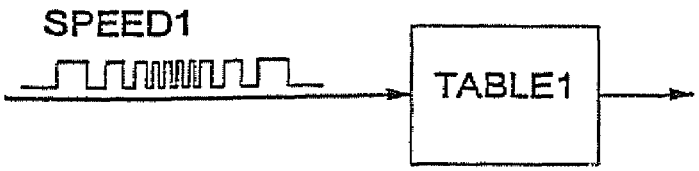
FIGS. 3*a* and 3*b* illustrate the implementation of a position-speed reference according to the invention.
Figure 3B:
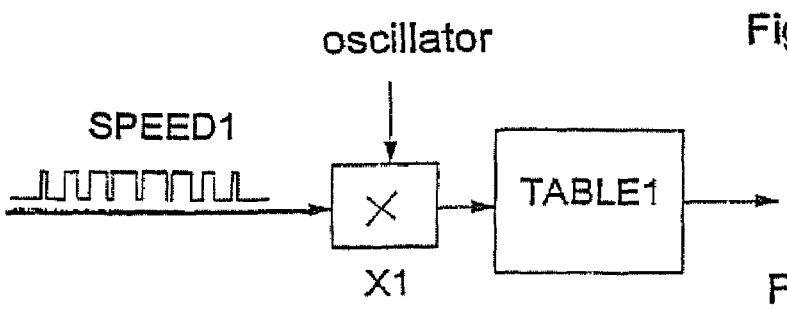

In the control system, the traditional control of the motor drive can be omitted and the computation of the speed profile is transferred to a traffic control block provided in the elevator control section. The system works as follows:

The position reference (FIG. 3*a* and 3*b*), which is obtained from motion control, is used directly to control the current or voltage signal to be fed into the motor M1. The position reference is a pulse diagram SPEED1, either frequency-coded (FIG. 3*a*) or PWM-coded (FIG. 3*b*), which is passed to a so-called look-up table block TABLE1, either directly (FIG. 3*a*) or via a multiplier X1, to which is also fed an oscillator signal (FIG. 3*b*). From the table block is obtained directly the vector phase of the voltage or current reference vector feeding the motor M1.

The essential feature of the invention is the use of the position reference as a channel interrupting the motion. Without the position reference, the voltage vector cannot rotate, and consequently the elevator cannot move (and will not cause a danger situation).

Motion control becomes simpler, and no speed profile is needed any more. Instead, the system utilizes a position profile, which may form part of very simple traffic control. Each pulse in the position profile moves the elevator through a certain distance.

As for torque control, it can be stated that, when a permanent magnet synchronous motor is used in an elevator without counterweight, there is no need to use torque control based on weighing of the load. The motion profile rotates the magnetic field of the motor, and the torque is generated automatically on the basis of the load-induced variation of the electrical angle of the motor.

The elevator control section must give some sort of torque reference because the torque varies in elevators of different sizes. The reference may be based on the elevator size or on the properties of the wire ropes and motor. In addition, the reference can be adjusted based on elevator car position feedback.

One method of controlling the torque is to generate a simple V/f conversion based on the position profile. In the present invention, another channel is used between the traffic control and the motor drive (e.g. a PWM signal).

As was already stated in connection with motion control, the safety of the motor drive is based on two channels between the traffic control and the motor drive: the position profile and the torque reference. If either of these is absent, the elevator cannot move.

The control system of the invention requires no operating parameters on the motor drive side. The motor is controlled by only two signals: position and torque.

Some sort of diagnostics is needed on the motor drive side as well. In this invention, diagnosing can be carried out while the elevator is stationary. The above-mentioned two channels can be used if they are bi-directional.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method for controlling an elevator without counterweight that does not change the torque direction said elevator having an alternating-current permanent magnet motor or asynchronous motor, and a motor drive section for controlling the motor and an elevator control section used to control the operation of the elevator, and wherein control channels are provided between the elevator control section and the motor drive section for the transmission of control signals, passing only position and torque control signals between the elevator control section and the motor drive to control the motor.

2. A method according to claim 1, wherein the motor is controlled by a pulse diagram wherein the speed has been coded as a position control signal, which is used to control the current or voltage signal to be fed into the motor.

3. A method according to claim 1, wherein a position profile is used, the computation of which is performed in the elevator control section.

4. A method according to claim 3, wherein the safety of the motor drive is based on two channels between the traffic control and the motor drive: the position profile and a torque reference, so that if either of these is absent, the elevator cannot move.

5. A system for controlling an elevator without counterweight that does not change the torque direction, said elevator having an alternating-current permanent magnet motor or asynchronous motor, and a motor drive section for controlling the motor and an elevator control section used to control the operation of the elevator, and wherein control channels are provided between the elevator control section and the motor drive section for the transmission of control signals, the system containing only two channels between the control section and the motor drive, only position and torque control signals being passed between the elevator control section and the motor drive to control the motor.

6. A system according to claim 5, wherein the elevator has a discoid alternating-current electric motor and its control system, which are disposed in the elevator shaft.

7. A system according to claim 5, wherein the control system comprises a drive section integrated in conjunction with the elevator motor and an elevator control section separate from it.

* * * * *

UNITED STATES PATENT AND TRADEMARK OFFICE

CERTIFICATE OF CORRECTION

PATENT NO. : 7,314,120 B2
APPLICATION NO. : 11/355099
DATED : January 1, 2008
INVENTOR(S) : Pekka Jahkonen It is certified that error appears in the above-identified patent and that said Letters Patent is hereby corrected as shown below:

Title Page,

After Item 65 insert the following:

Item --(30) Sep. 10, 2003 (FI) ..... 20031295--

Signed and Sealed this

Ninth Day of November, 2010

David J. Kappos

David J. Kappos
*Director of the United States Patent and Trademark Office*